US006470980B1

(12) United States Patent
Dodd

(10) Patent No.: US 6,470,980 B1
(45) Date of Patent: Oct. 29, 2002

(54) SELF-EXCITED DRILL BIT SUB

(76) Inventor: Rex A. Dodd, 2401 Neely, Midland, TX (US) 79705

( * ) Notice: Subject to any disclaimer, the term of this patent is extended or adjusted under 35 U.S.C. 154(b) by 99 days.

(21) Appl. No.: 09/694,056

(22) Filed: Oct. 3, 2000

Related U.S. Application Data

(63) Continuation-in-part of application No. 09/448,216, filed on Nov. 23, 1999, now abandoned, which is a continuation of application No. 08/903,226, filed on Jul. 22, 1997, now Pat. No. 6,029,746.

(60) Provisional application No. 60/167,119, filed on Nov. 23, 1999.

(51) Int. Cl.[7] ..... E21B 10/60

(52) U.S. Cl. ..... 175/393; 175/340; 175/424

(58) Field of Search ..... 175/424, 393, 175/339, 340; 166/312, 222; 239/548, DIG. 8, DIG. 13

(56) References Cited

U.S. PATENT DOCUMENTS

| | | | | |
|---|---|---|---|---|
| 1,230,666 | A | 6/1917 | Carden | 166/104 |
| 1,333,390 | A | 3/1920 | Dickenson | 166/104 |
| 2,437,456 | A | 3/1948 | Bodine, Jr. | 166/311 |
| 2,466,182 | A | 4/1949 | Peeps | 299/143 |
| 2,574,141 | A | 11/1951 | Brown | 166/146 |
| 2,661,065 | A | 12/1953 | McCoy | 166/105 |
| 2,933,259 | A | 4/1960 | Raskin | 239/405 |
| 3,520,362 | A | 7/1970 | Galle | 166/249 |
| 3,693,887 | A | 9/1972 | Brodlin, et al. | 239/500 |
| 3,730,269 | A | 5/1973 | Galle | 166/177 |
| 3,796,371 | A | 3/1974 | Taylor et al. | 239/101 |
| 3,842,907 | A | 10/1974 | Baker et al. | 166/249 |
| 3,850,135 | A | 11/1974 | Galle | 116/137 A |

(List continued on next page.)

FOREIGN PATENT DOCUMENTS

JP 402240392 A * 9/1990

OTHER PUBLICATIONS

Z.F. Liao and D.S. Huang, "Nozzle Device for the Self–Excited Oscillation of a Jet," Eighth International Symposium on Jet Cutting Technology, Sep. 1986, Paper 19, pp. 195–201.

R.A. Payne, K.A. Williams, L.L. Pelty and H.L. Bailey, "Pressure Fluctuating Tool," Society of Petroleum Engineers 1985 Production Operations Symposium, Mar. 1985, pp. 105–109.

Z.F. Liao, C.L. Tang, "Pulsed Jet Nozzle for Oilwell Jetting Drilling," Society of Petroleum Engineers, May 1992, Paper 24288.

R. Liao, J. Wu, and H.C. Juvkam–Wold, "New Nozzle to Increase Drilling Rate by Pulsating Jet Flow," 1994 IADC/SPE Drilling Conference, Feb. 1994, Paper 27468, pp. 335–343.

*Primary Examiner*—David Bagnell
*Assistant Examiner*—Zakiya Walker
(74) *Attorney, Agent, or Firm*—Locke Liddel & Sapp LLP; Monty L. Ross

(57) ABSTRACT

A drill bit sub attachable to a drilling string above the drill bit, the sub having an oscillation chamber with at least two radially and axially spaced, annular impingement surfaces interconnected by an inclined annular surface. The oscillation chamber is preferably coaxially aligned and in fluid communication with upper and tubular bores that each have diameters less than the diameter of the chamber. The oscillation chamber preferably has a diameter from about three to about five times the diameter of the upper tubular bore and a height between 1.6 and 5.6 times the diameter of the upper tubular bore. The diameter of the lower tubular bore is preferably about 1.3 times the diameter of the upper tubular bore.

14 Claims, 4 Drawing Sheets

U.S. PATENT DOCUMENTS

| | | | | | |
|---|---|---|---|---|---|
| 4,011,996 | A | | 3/1977 | Tsuji et al. | 239/491 |
| 4,031,971 | A | | 6/1977 | Miller | 175/107 |
| 4,041,984 | A | | 8/1977 | Morel | 137/842 |
| 4,231,519 | A | | 11/1980 | Bauer | 239/102 |
| 4,276,943 | A | | 7/1981 | Holmes | 175/40 |
| 4,280,557 | A | | 7/1981 | Bodine | 166/177 |
| 4,287,957 | A | * | 9/1981 | Evans | 175/17 |
| 4,580,727 | A | | 4/1986 | Moos | 239/403 |
| 4,630,689 | A | | 12/1986 | Galle et al. | 175/56 |
| 4,669,566 | A | | 6/1987 | Shay | 239/428.5 |
| 4,673,037 | A | | 6/1987 | Bodine | 166/249 |
| 4,806,172 | A | | 2/1989 | Adaci et al. | 134/34 |
| 4,923,169 | A | | 5/1990 | Grieb et al. | 251/118 |
| 4,991,667 | A | | 2/1991 | Wilkes, Jr. et al. | 175/61 |
| 5,035,361 | A | | 7/1991 | Stouffer | 239/589.1 |
| 5,067,655 | A | | 11/1991 | Farago et al. | 239/124 |
| 5,133,502 | A | | 7/1992 | Bendig et al. | 239/504 |
| 5,135,051 | A | | 8/1992 | Facteau et al. | 166/104 |
| 5,165,438 | A | | 11/1992 | Facteau et al. | 137/1 |
| 5,228,508 | A | | 7/1993 | Facteau et al. | 166/177 |
| 5,311,955 | A | * | 5/1994 | Ganijew et al. | 175/67 |
| 5,423,483 | A | | 6/1995 | Schwade | 239/11 |
| 5,495,903 | A | * | 3/1996 | Griffin et al. | 175/424 |
| 5,651,420 | A | * | 7/1997 | Tibbitts et al. | 175/102 |
| 5,732,885 | A | | 3/1998 | Huffman | 239/416.5 |
| 5,862,871 | A | * | 1/1999 | Curlett | 175/340 |

* cited by examiner

SELF-EXCITED DRILL BIT SUB

CROSS-REFERENCE TO RELATED APPLICATION

This application is a continuation-in-part of application Ser. No. 09/448,216, filed Nov. 23, 1999, now abandoned, which is a continuation of application Ser. No. 08/903,226, filed Jul. 22, 1997, now U.S. Pat. No. 6,029,746, and also claims priority from provisional application Ser. No. 60/167,119, filed Nov. 23, 1999.

BACKGROUND OF THE INVENTION

1. Field of the Invention

This invention relates generally to tools that are used for drilling water and hydrocarbon wells and, more particularly, to a drill bit sub that generates a pulsating jet flow in drilling fluid circulated through a conventional drill bit. The drill bit sub of the invention can be used with either drill pipe or coiled tubing. Use of the subject drill bit sub to achieve greater reaches during horizontal drilling is also disclosed.

2. Description of Related Art

It has been suggested in the prior art to use acoustic energy for stimulating producing wells. A fluidic oscillator may be used to create pressure fluctuations to induce stress in the walls of the perforation tunnel, thereby increasing production and cleaning perforations as disclosed in U.S. Pat. Nos. 5,135,0531 and 5,228,508 issued to Facteau. The pressure fluctuations of the Facteau tool are generated from an oscillation chamber with two outlet ports. A similar fluidic oscillation chamber with dual outlet ports is disclosed in U.S. Pat. No. 5,165,438 also issued to Facteau. Another stimulation tool using acoustic energy is disclosed in U.S. Pat. No. 3,520,362 issued to Galle. Although the above recited tools seemed feasible, there exists a practical difficulty of delivering sufficient acoustic power to the producing formation for the desired stimulation and/or to the area to be cleaned.

IADC/SPE paper 27468 teaches the use of Helmholtz oscillator theory for generating a pulsating jet flow in drill bits. The pulsating jet flow is said to produce much higher instantaneous jet velocity and impact pressure than experienced with non-pulsating flow, resulting in significant improvements in hole cleaning and drilling rate. Pulsed high pressure water jets are known to have advantages over continuous jet streams for use in cutting materials, especially brittle materials. By exerting an alternating load on materials, pulsed jets can produce not only extremely high momentary pressures (i.e. water hammer effect) in the materials, but also absolute tensile stress, which gives rise to unloading destruction of brittle materials, through reflection of the stress waves. Pulsating jet flow is also known to reduce the hydraulic hold-down effect, thereby increasing the cutting and cleaning action of the jet. IADC/SPE 27468 discloses a new nozzle that generates the pulsating jet flow by a self-oscillation of fluid in the oscillation chamber. A "bump surface" at the bottom of the oscillation chamber, shown for example in FIG. 3, is said to be a key factor in the quality of the pulsating jet flow. The article concludes that the nozzle shape, manufacturing technique, and the bit structure may be further studied to improve the pulsating jet flow quality.

A discussion of design parameters for self-excited oscillation jet nozzles is included in a paper entitled "Nozzle Device for the Self-Excited Oscillation of a Jet" presented as Paper 19 at the 8th International Symposium on Jet Cutting Technology held in Durham, England, Sep. 9–11, 1986 and available from BHRA, the Fluid Engineering Centre, Cranfield, Bedford MK430AJ, England.

A drill bit sub is needed, however, that can create a self-excited, pulsating flow of drilling fluid in an oscillation chamber above a conventional drill bit of the type typically employed for drilling water, oil and gas wells using either a standard drilling string or coiled tubing. The desired drill bit sub should be useable with cone, blade or PDC bits having single or multiple ports.

SUMMARY OF THE INVENTION

The present invention comprises a self-excited drill bit sub that creates a pulsating flow of drilling fluid utilizing Helmholtz oscillation theory prior to entering the drill bit. The pulsating stream is caused by vortices which are created inside the tool by structural features not disclosed in the prior art. The vortices create pressure pulses as they leave the sub and travel into and through the ports in the drill bit. The cyclic pressure pulses facilitate cutting and removal of cuttings from the interface between the drill bit and the formation. In contrast to drill bits using jet nozzles that generate pulsed flow, the drill bit sub of the invention provides a longer flow path for the pulsed flow prior to exiting the bit, providing a more steady flow through the bit, and causing less erosion of the nozzles. Use of the drill bit sub disclosed herein also insures that all bit nozzles are pulsing in unison, and reduces the likelihood of forming a destructive standing wave when rotating while pulsating during drilling.

The drill bit sub of the invention desirably includes an elongated tubular first member adapted on an upper end for connection to a running string. The first member includes an upper portion with a central bore open to a top of the tool, and a lower portion having a cylindrical shaped cavity open to a bottom surface of the first member. The cylindrical cavity is internally threaded in a lower portion and has an internal diameter larger than the diameter of the central bore of the upper portion. The cylindrical cavity has an interior wall height of the unthreaded portion that is less than the diameter of the cylindrical cavity. The central bore of the first member is open to the cylindrical cavity for delivering drilling fluid supplied through the running string.

The drill bit sub further includes a second elongated tubular member having an upwardly directed, male threaded end and a central bore having a diameter larger than the diameter of the central bore of the first member but less than the diameter of the cylindrical cavity of the first member. Importantly, the top end surface of the second tubular member comprises a truncated annular conical projection having a blunt annular horizontal surface adjacent to the bore, a conical shoulder extending downward and radially outward from the blunt surface, and another annular horizontal surface extending radially outward between the base of the conical shoulder and the threaded edge of the male end. The male threads on the top of the second tubular member are receivable in the internally threaded lower portion of the first member. The second tubular member also preferably includes a downwardly facing, female threaded box end adapted to receive the male threaded pin end of a drill bit so that, when connected, the bit sub discharges pulsating drilling fluid through the bit exit ports and against the formation. When the drill bit sub of the invention is assembled with the male end of the second member threaded into the lower female end of the first member, an internal oscillation chamber is formed.

According to another preferred embodiment of the invention, a drill bit sub is provided that comprises an oscillation chamber disposed above a drill bit, the drill bit sub having at least two radially and axially spaced, annular impingement surfaces interconnected by an inclined annular surface. The oscillation chamber is preferably coaxially aligned and in fluid communication with upper and tubular bores that each have diameters less than the diameter of the chamber. According to a particularly preferred embodiment of the invention, the oscillation chamber has a diameter from about three to about five times the diameter of the upper tubular bore and a height between 1.6 and 5.6 times the diameter of the upper tubular bore. The diameter of the lower tubular bore is preferably about 1.3 times the diameter of the upper tubular bore.

In accordance with the present invention, the subject drill bit sub is easily fabricated and assembled, has no moving parts, and significantly increases the drilling rate as compared to a drill string using the same bit without the bit sub of the invention. In drilling, the subject drill bit sub achieves a higher penetration rate due to the higher impact pressure created from pulsing the jet stream and the reduction of the "hydraulic hold-down effect" on the cuttings that is caused by conventional straight jets. The drill bit sub of the invention not only aids in the break-up of hard, brittle material but also aids in the cleaning of the bit and removal of debris from the hole bottom. The ability to keep the bit clean and the hole bottom free of debris causes the drill bit/hole bottom contact to be greatly increased, thereby increasing the bit penetration rate. Use of the subject drill bit sub requires no other changes in drilling procedure.

Some of the advantages of locating the oscillator of the invention in a separate drill bit sub above the drill bit are:

- the sub can be made in various sizes to adapt to any size bit and collar combinations;
- there is ample space to machine the oscillator directly into the collar;
- the porting can be large enough to eliminate the "washing" effect due to high pressures and abrasive material;
- by using no moveable parts, the oscillator will operate at its maximum efficiency;
- "plugging" of the ports is virtually eliminated due to the port sizing; and
- the drill bit sub can be machined from 4140 heat treated and hardened to s 2832 Rockwell C hardness, which is the same hardness as material used to make drill collars.

BRIEF DESCRIPTION OF THE DRAWINGS

The apparatus of the invention is further described and explained in relation to the following figures of the drawings in which.

Like reference numerals are used to designate like parts in all figures of the drawings.

DETAILED DESCRIPTION

Figure 1:
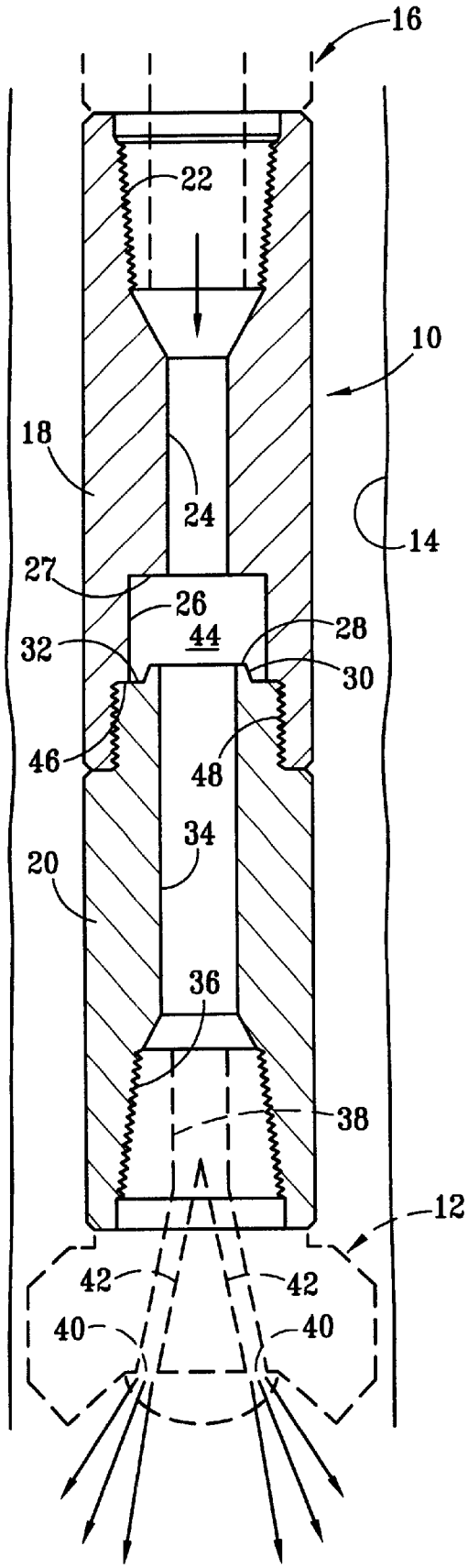
FIG. 1 is a simplified cross-sectional elevation view of a preferred embodiment of the self-excited, pulsating drill bit sub of the invention as employed on a drill string inside a well bore.
Figure 2:
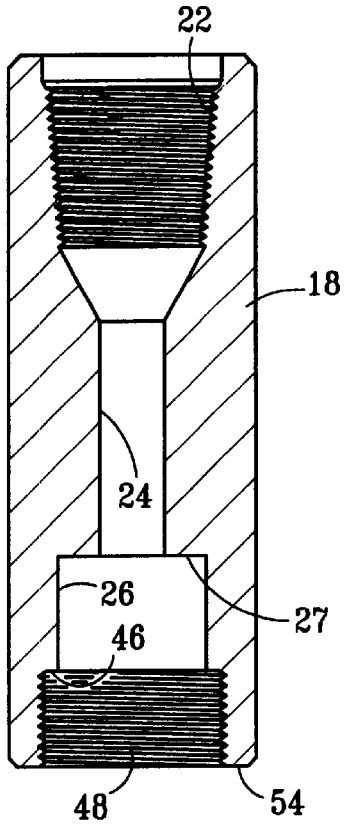
FIG. 2 is a cross-sectional elevation view of the upper member of the subject drill bit sub.
Figure 3:
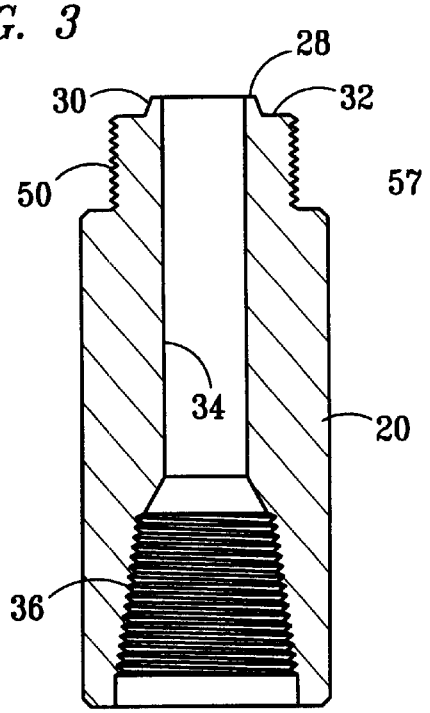
FIG. 3 is a cross-sectional elevation view of the lower member of the subject drill bit sub.

Referring to FIGS. 1–3, the present invention is a self-excited drill bit sub 10 that creates a pulsating jet flow within a conventional drill bit 12 utilizing Helmholtz oscillation theory. Drill bit 12 can be, for example, a cone, blade or PDC bit having single or multiple outlet ports. Drill bit sub 10 is suspended in well bore 14 on a running string 16 comprising either coiled tubing or conventional tubing that extends upwards to the surface. It will be understood by those skilled in the art that the running string may include conventional 2⅜ inch or 2⅞ inch diameter upset tubing, 1 inch macaroni string tubing or coiled tubing. In some applications, crossovers, as well known in the art, may be needed to connect the drill bit sub 10 to the running string 16.

Drill bit sub 10 of the invention preferably comprises upper tubular member 18 and lower tubular member 20. Referring to FIGS. 1 and 2, upper tubular member 18 further comprises female threaded box end 22 adapted to receive the male threaded pin end of a drill collar on running string 16. Central bore 24 extends axially through upper tubular member 18 from box end 22 to a substantially cylindrical section bounded by sidewall 26, which desirably has a diameter greater than that of central bore 24 and, together with annular divider wall 27, forms the side and top walls, respectively, of oscillation chamber 44. Referring to FIG. 2, the lower end 54 of upper tubular member 18 preferably comprises another substantially cylindrical section having female Acme threads 48.

Referring to FIGS. 1 and 3, lower tubular member 20 of drill bit sub 10 further comprises central bore 34 and terminates at its upper end in an annular, truncated conical projection having a flat annular ledge surface 28 surrounded on the outside by tapered conical shoulder 30, and a flat, upwardly facing annular surface 32 that abuts against downwardly facing shoulder 46 of upper tubular member 18 between cylindrical section 26 and female Acme threads 48. Annular surfaces 28, 32 of lower tubular member 20 and inclined annular shoulder 30 between them cooperate with cylindrical sidewall 26 and annular divider wall 27 to define the walls of oscillation chamber 44. Central bore 34 extends axially through lower tubular member 20 from its top end to a female-threaded, downwardly facing box end 36 that is adapted to receive a cooperatively threaded pin end of drill bit 12 (shown in dashed outline in FIGS. 1 and 5 ) having at least one discharge port 40 connected by a passageway 42 to central bore 34 of lower tubular member 20.

Referring to FIG. 3, the outside diameter of lower tubular member 20 is preferably reduced near its top end and is desirably provided with male Acme threads 50 that cooperatively engage female threads 48 of upper tubular member 18. Referring to FIGS. 2 and 3, shoulder 52 of lower tubular member 20 and lower end 54 of upper tubular member 18 are also placed in abutting contact when upper and lower tubular members 18, 20, respectively, are threaded together to form oscillation chamber 44.

Figure 4:
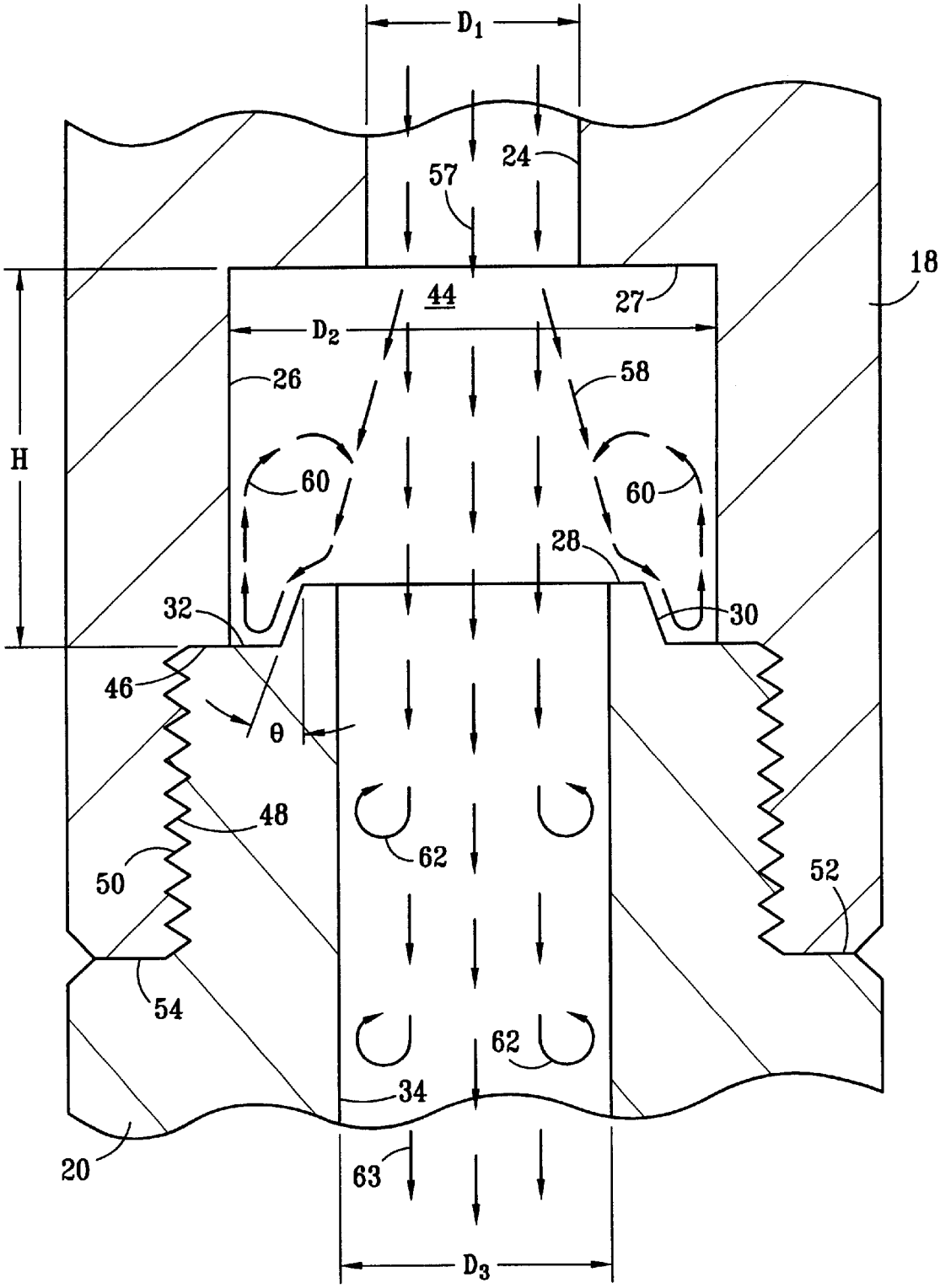
FIG. 4 is an enlarged, diagrammatic view showing the flow of drilling fluid within the oscillation chamber and the vortices that are created within the oscillation chamber to cause the pulsating flow to the drill bit.

When drill bit sub 10 is assembled with the upper portion of lower tubular member 20 threadedly engaged in the lower portion of upper tubular member 18 as shown in FIG. 1, internal oscillation chamber 44 is formed. In order for oscillation chamber 44 to function in the desired manner to form vortices and excite a pulsating flow within and through drill bit sub 10, there are preferred ratios for the dimensions of different portions of the sub. Referring to FIG. 4, the diameter of central bore 24 extending axially through upper tubular member 18 is identified as $D_1$. The internal diameter of sidewall section 26 of upper tubular member 18 is identified as $D_2$ and the height of sidewall section 26 is identified as H. The diameter of central bore 34 of lower tubular section 20 is identified as $D_3$. Although it should be appreciated that the drawing figures are not drawn to scale, for preferred generation of vortices in oscillation chamber 44, $D_2$ ranges from about 3 to about 5 times $D_1$; height $H_1$ ranges between 1.6 and 5.6 times $D_1$, and most preferably about 3 times $D_1$; and $D_3$ is most preferably about 1.3 times $D_1$. Tapered conical shoulder 30 preferably extends downwardly and outwardly at an angle 2 that is about 30 degrees from vertical. The width of annular surface 28 is desirably at least about ⅛ inch. While the recited proportions and dimensions are preferred for use in the invention, it will be appreciated that beneficial results can also be achieved where the dimensions vary within reasonable limits from those recited.

Figure 5:
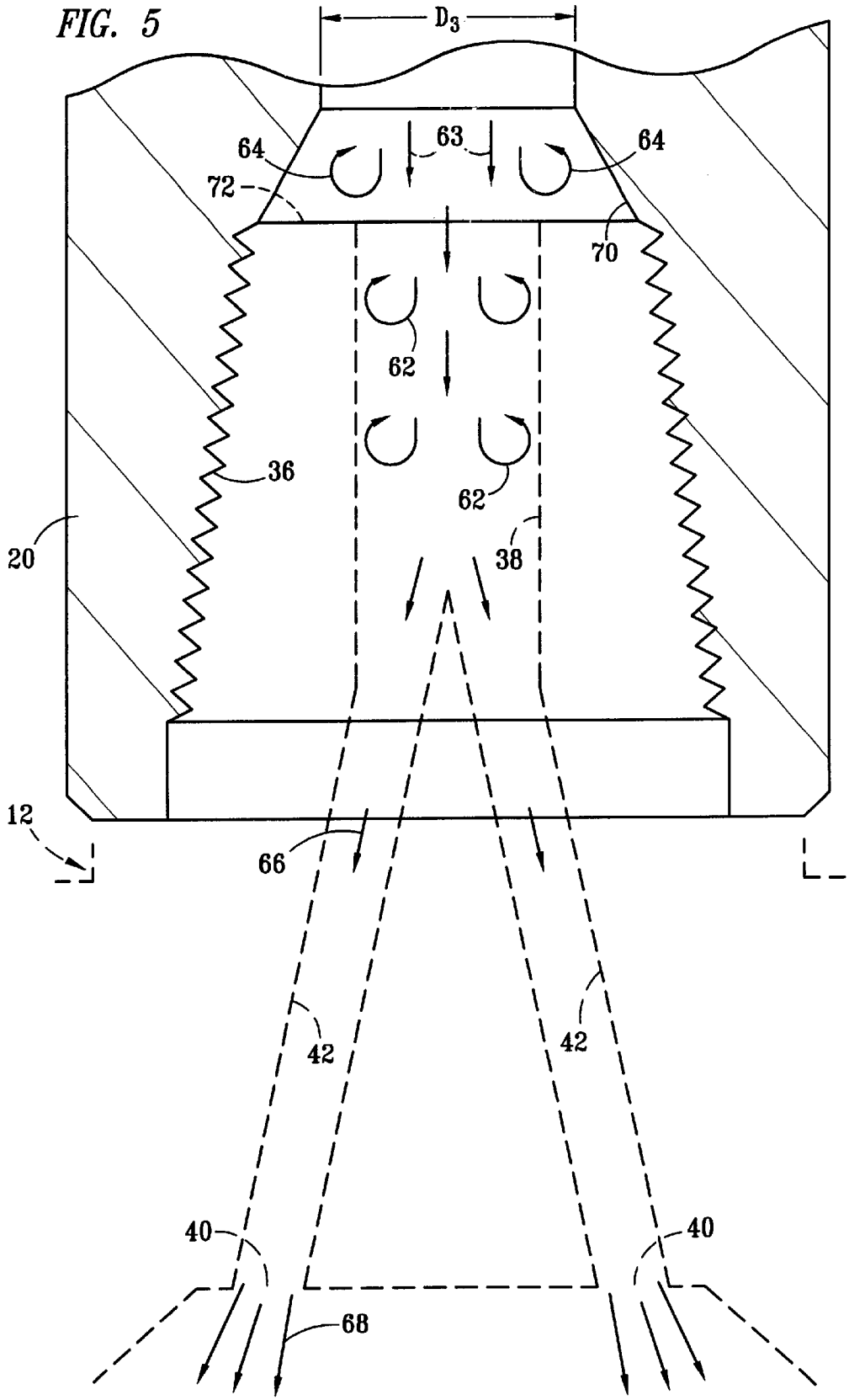
FIG. 5 is an enlarged, diagrammatic view showing the flow of pulsating drilling fluid out of the drill bit sub and into and through the exit ports of a drill bit (shown in dashed outline).

Referring to FIGS. 4 and 5, drilling fluid directed downward through the tubing string as indicated by arrows 57 spreads outwardly upon entering oscillation chamber 44, as indicated diagrammatically by arrows 58. That portion of the fluid flow that contacts blunt annular surface 28, conical surface 30 and annular surface 32 is redirected, forming vortices 60 that cause the fluid to pulse as it travels downwardly into and through central bore 34. Smaller vortices 62 in pulsed turbulent flow 63 continue downwardly through bore 34. Referring to FIG. 5, additional vortices 64 are formed when flow 63 expands radially upon entering the conical section bounded by sidewall 70 above female threaded box portion 36 of lower tubular member 20 and contacts annular end 68 of the pin end of a drill bit 12 (partially shown in phantom outline) when engaged with the box end of member 20. The pulsed flow containing vortices 62 then continues downwardly through bore section 38, passages 42 and exit ports 40 of the drill bit, as shown by flow lines 66, 68. Passages 42 and exit ports 44 are preferably sized so that there is no restriction in cross-sectional area as the drilling fluid passes through bore 38, passages 42 and ports 40 of bit 12.

Table A includes dimensions $D_2$, $D_1$, $D_3$ and H (inches) and $D_1$ and $D_3$ Areas (square inches) for selected embodiments of the present invention. It will be understood by those skilled in the art that the present invention is not limited to the disclosed preferred embodiments as listed in Table A below:

TABLE A

| $D_2$ | $D_1$ | $D_3$ | H | $D_1$ AREA | $D_3$ AREA |
|---|---|---|---|---|---|
| 1.0000 | 0.3438 | 0.4469 | 1.0314 | 0.0928 | 0.1569 |
| 1.0000 | 0.3750 | 0.4875 | 1.1250 | 0.1104 | 0.1867 |
| 1.0000 | 0.4062 | 0.5281 | 1.2186 | 0.1296 | 0.2190 |
| 1.0000 | 0.4375 | 0.5688 | 1.3125 | 0.1503 | 0.2541 |
| 1.0000 | 0.4688 | 0.6094 | 1.4064 | 0.1726 | 0.2917 |
| 1.0000 | 0.5000 | 0.6500 | 1.5000 | 0.1964 | 0.3318 |
| 1.0000 | 0.5312 | 0.6906 | 1.5936 | 0.2216 | 0.3745 |
| 1.0000 | 0.5625 | 0.7313 | 1.6875 | 0.2485 | 0.4200 |
| 1.0000 | 0.5938 | 0.7719 | 1.7814 | 0.2769 | 0.4680 |
| 1.0000 | 0.6250 | 0.8125 | 1.8750 | 0.3068 | 0.5185 |
| 1.0000 | 0.6562 | 0.8531 | 1.9686 | 0.3382 | 0.5715 |
| 1.0000 | 0.6875 | 0.8938 | 2.0625 | 0.3712 | 0.6274 |
| 1.0000 | 0.7189 | 0.9346 | 2.1567 | 0.4059 | 0.6860 |
| 1.0000 | 0.7500 | 0.9750 | 2.2500 | 0.4418 | 0.7466 |
| 1.0000 | 0.8125 | 1.0563 | 2.4375 | 0.5185 | 0.8762 |
| 1.0000 | 0.8750 | 1.1375 | 2.6250 | 0.6013 | 1.0162 |
| 1.0000 | 0.9375 | 1.2188 | 2.8125 | 0.6903 | 1.1666 |

TABLE A-continued

| $D_2$ | $D_1$ | $D_3$ | H | $D_1$ AREA | $D_3$ AREA |
|---|---|---|---|---|---|
| 1.0000 | 1.0000 | 1.3000 | 3.0000 | 0.7854 | 1.3273 |
| 1.0000 | 1.1250 | 1.4625 | 3.3750 | 0.9940 | 1.6799 |
| 1.0000 | 1.2500 | 1.6250 | 3.7500 | 1.2272 | 2.0739 |
| 1.0000 | 1.3750 | 1.7875 | 4.1250 | 1.4849 | 2.5095 |
| 1.0000 | 1.5000 | 1.9500 | 4.5000 | 1.7672 | 2.9865 |
| 1.0000 | 1.6250 | 2.1125 | 4.8750 | 2.0739 | 3.5050 |
| 1.0000 | 1.7500 | 2.2750 | 5.2500 | 2.4053 | 4.0649 |
| 1.0000 | 1.8750 | 2.4375 | 5.6250 | 2.7612 | 4.6664 |
| 1.0000 | 2.0000 | 2.6000 | 6.0000 | 3.1416 | 5.3093 |
| 1.0000 | 2.2500 | 2.9250 | 6.7500 | 3.9761 | 6.7196 |

In constructing drill bit sub 10, the dimension $D_1$ is desirably selected first, based on the desired flow rate and pressure drop to be encountered through the tool. The dimensions $D_3$ and H are then calculated according to the preferred design parameters described above.

Although the present invention is not limited by the following description, it is believed that because the diameter $D_2$ of the oscillation chamber is much larger than the diameter $D_1$ of the inlet bore 24, the speed of the fluid in oscillation chamber 44 is slower than that of the inlet jet. This difference in fluid speed creates fierce shear movement at the interface between the fast and slower moving fluids in chamber 44. Because of the viscosity of the fluid there must be a momentum exchange between the two fluid components through the interface. The shear flow results in vortices. With the inlet bore being round, the vortex lines take the shape of a circle; i.e., the vortices come about and move in the form of a vortex ring. The impingement of orderly axis-symmetric disturbances, such as the vortex ring, in the shear layer on the edge of the discharge bore generates periodic pressure pulses. These pressure pulses propagate upstream to the sensitive initial shear layer separation region and induce further fluctuations in the vortices. The inherent instability of the shear layer amplifies small disturbances imposed on the initial region. This amplification is selective; i.e., only disturbances with a narrow frequency range get amplified. Where f=frequency; $U_0$=velocity at the jet axis; $D_1$=diameter of the inlet bore; and SD=dimensionless frequency=$fD_1/U_o$; if the frequency of a disturbance is $f=S_D U_O/D_1$ the disturbance will receive maximum amplification in the jet shear layer between the initial separation region and the impingement zone. The amplified disturbance travels downstream to impinge on the edge again. Thereupon the events above are repeated in a loop consisting of emanation, feedback and amplification of disturbances. As a result, a strong oscillation is developed in the shear layer and even in the jet core. A fluctuation pressure field is set up within the oscillation chamber 44. The velocity of the jet emerging from bore 34 varies periodically, thus a pulsed jet is produced. The oscillation is referred to as self-excited oscillation because it comes into being without any external control or excitation. Low frequency, self-excited oscillation is observed when the oscillation chamber height H, varies in the range of $1.6<H/D_1<5.6$. Low frequency oscillation has a relatively high pressure fluctuation rate. In a desired range of operation bit sub 10 creates pressure pulsations between 100 and 245 cycles per second.

The following are results of a test which took place in a field in Texas. The controls of the test were to install the drill bit sub of the invention in the drill string and drill as normal the type of bit and formation in the area.

| | BIT SIZE | IN | OUT | FOOTAGE | HR'S. | FPH |
|---|---|---|---|---|---|---|
| VORTECH #1-A | 7 ⅞" | 3610 | 5100 | 1490 | 46.25 | 32.22 |
| OFF-SET #1 | 7 ⅞" | 3606 | 5150 | 1544 | 57 | 27.09 |
| IN-FIELD #4 | 7 ⅞" | 3587 | 5110 | 1523 | 52.5 | 29.01 |
| OFF-SET #3 | 7 ⅞" | 3610 | 5130 | 1520 | 68.75 | 22.11 |

All of the wells were drilled with the same drilling rig and crew. The results of the bit inspection indicated there was no adverse effect on the drill bit. The caliper logs showed no wash-outs in the drilled hole size that were abnormal for the field. There was no change in the degree of deviation beyond that normal for the field. The cuttings which were examined during the drilling process appeared no different than in the other wells.

Another example of the efficiencies achievable through use of the drill bit sub of the invention involved an application where the drill bit sub was used in drilling out 10,500 feet of cemented well bore casing. The drilling operation was expected to take 8–10 days using normal (no bit sub) procedures. With the bit sub of the invention, the job was completed in 61 hours. A further indication of the increased rate of penetration ("ROP") achieved through use of the invention is that experienced members of the operation said that whereas they normally would only be able to drill three 30 ft. pipe joints an hour, use of the invention increased the ROP to 10 joints per hour. The rate was actually restricted to enable cuttings being produced to circulate out of the well bore.

Although preferred and alternate embodiments of the invention have been illustrated in the accompanying drawings and described in the foregoing detailed description, it will be understood the invention is not limited to the embodiments disclosed but is capable of numerous modifications without departing from the scope of the invention as claimed.

I claim:

1. A drill bit sub attachable between a running string and a drill bit for use in drilling a well, the sub comprising cooperatively threaded upper and lower tubular members defining an oscillation chamber therebetween, the upper tubular member comprising an upper section having an axial bore with a first diameter, the axial bore being bounded at a lower end by a substantially flat, downwardly facing, first annular surface, a middle section having a second coaxial bore defined by a sidewall with an upper end terminating at the first annular surface, the second coaxial bore having a second diameter from about 3 to about 5 times greater than the first diameter, an axial length ranging from about 1.6 to about 5.6 times the first diameter, and a lower, downwardly facing, threaded section, the lower tubular member comprising an upwardly extending portion cooperatively threaded for engagement with the downwardly facing, threaded section of the upper tubular member, the upwardly extending portion having a third coaxial bore with a diameter greater than the first diameter of the upper tubular member, the upwardly extending portion terminating in an upwardly facing, substantially flat, second annular surface having a width of at least about ⅛inch, the second annular surface being surrounded by a downwardly and outwardly extending truncated conical surface, the conical surface having a base surrounded by a third, substantially flat annular surface having an outer perimeter coextensive with the sidewall of the cylindrical bore of the middle section of the upper tubular member, the first, second and third annular surfaces, sidewall and truncated conical surface cooperating to define an oscillation chamber within the drill bit sub whenever the upper and lower tubular members are threadedly engaged, the lower tubular member further comprising a downwardly opening, coaxially aligned, threaded section attachable to a drill bit.

2. The drill bit sub of claim 1 wherein the axial length of the second coaxial bore is about 3 times the first diameter.

3. The drill bit sub of claim 1 wherein the diameter of the third coaxial bore is about 1.3 times the first diameter.

4. The drill bit sub of claim 1 wherein the truncated conical surface intersects the second annular surface at an angle about 30 degrees from vertical.

5. The drill bit sub of claim 1 wherein the upper and lower tubular members are engageable with acme threads.

6. The drill bit sub of claim 1 wherein the upper tubular member has a female threaded box end above the first axial bore.

7. The drill bit sub of claim 1 wherein the lower tubular member has a female threaded box end below the third coaxial bore.

8. A self-excited drill bit sub useful for converting steady flow to pulsating flow in a drilling string above a drill bit inside a well, the drill bit sub comprising:

an upper tubular bore having a first internal diameter;

an oscillation chamber coaxially aligned below the upper tubular bore and communicating therewith, the oscillation chamber having an axial length and a second internal diameter;

a lower tubular bore coaxially aligned below the oscillation chamber and communicating therewith, and having a third internal diameter;

a first set of threads attachable to the drilling string; and a second set of threads attachable to the drill bit;

the oscillation chamber further comprising at least two radially and axially spaced, upwardly facing, annular impingement surfaces interconnected by an inclined annular surface.

9. The drill bit sub of claim 8 wherein the annular impingement surface nearer the upper tubular bore is at least ⅛inch wide.

10. The drill bit sub of claim 8 wherein the diameter of the lower tubular bore is about 1.3 times the diameter of the upper tubular bore.

11. The drill bit sub of claim 8 wherein the diameter of the oscillation chamber is from about 3 to about 5 times the diameter of the first tubular bore.

12. The drill bit sub of claim 8 wherein the height of the oscillation chamber is between 1.6 and 5.6 times the diameter of the first tubular bore.

13. The drill bit sub of claim 12 wherein the height of the oscillation chamber is about 3 times the diameter of the first tubular bore.

14. The drill bit sub of claim 8 wherein the inclined annular surface is about 30° from vertical.

* * * * *